United States Patent [19]

Vataru et al.

[11] Patent Number: 4,809,769

[45] Date of Patent: Mar. 7, 1989

[54] ENGINE COOLANT FLUSH-FILTERING USING EXTERNAL GAS PRESSURE

[75] Inventors: Marcel Vataru, Los Angeles; Richard W. Smith, Placentia; Rainer H. Labus, Burbank, all of Calif.

[73] Assignee: Wynn Oil Company, Azusa, Calif.

[21] Appl. No.: 212,174

[22] Filed: Jun. 27, 1988

Related U.S. Application Data

[62] Division of Ser. No. 087,696, Aug. 20, 1987.

[51] Int. Cl.[4] ..... F28G 13/00

[52] U.S. Cl. ..... 165/1; 165/95; 165/134.1; 210/167; 210/805; 204/148; 123/41.14

[58] Field of Search ..... 165/95, 119, 134.1, 165/1; 204/196, 197; 123/41.14; 210/167, 171, 172, 696, 243, 805; 417/118

[56] References Cited

U.S. PATENT DOCUMENTS

| | | | |
|---|---|---|---|
| 1,742,281 | 1/1930 | Rundlett | 210/790 |
| 3,002,909 | 10/1961 | Heidt | 204/148 |
| 3,034,521 | 5/1962 | Greenfield | 165/95 X |
| 3,540,528 | 11/1970 | Moon | 165/119 |
| 3,540,588 | 11/1970 | Estabrook | 210/788 |
| 3,653,430 | 4/1972 | Kinast | 165/11 |
| 3,776,384 | 12/1983 | Offer | 210/209 |
| 3,954,611 | 5/1976 | Reedy | 210/695 |
| 3,960,208 | 6/1976 | Anthony et al. | 165/1 |
| 4,083,399 | 4/1978 | Babish et al. | 165/95 |
| 4,128,140 | 12/1978 | Riches | 184/1.5 |
| 4,161,979 | 7/1979 | Stearns | 165/95 |
| 4,176,708 | 12/1979 | Joffe | 165/95 |
| 4,343,353 | 8/1982 | Tsopelas | 165/119 |
| 4,366,069 | 12/1982 | Dudrey et al. | 210/788 |
| 4,390,049 | 6/1983 | Albertson | 141/92 |
| 4,606,363 | 8/1986 | Scales | 134/111 |

FOREIGN PATENT DOCUMENTS

| | | | |
|---|---|---|---|
| 1028634 | 2/1953 | France | 210/167 |
| 2086488A | 5/1982 | United Kingdom | 417/118 |

OTHER PUBLICATIONS

See also U.S. application S.N. 033,576, filed Apr. 2, 1987, by assignee of applicants herein.

*Primary Examiner*—Samuel Scott
*Assistant Examiner*—Allen J. Flanigan
*Attorney, Agent, or Firm*—William W. Haefliger

[57] ABSTRACT

A method for rapid cleaning of an internal combustion engine cooling system includes:

forcing the coolant liquid from the cooling system to the exterior of that system, treating the coolant liquid in a zone or zones outside the cooling system, said treating including removing contaminant from the coolant liquid, and returning the treated coolant liquid to the cooling system.

18 Claims, 1 Drawing Sheet

ENGINE COOLANT FLUSH-FILTERING USING EXTERNAL GAS PRESSURE

This is a division of application Ser. No. 087,696 filed Aug. 20, 1987.

BACKGROUND OF THE INVENTION

This invention relates generally to cleaning of internal combustion engine cooling system, more particularly to treatment of used coolant exteriorly of such a system for subsequent return to the system.

Studies show that over-heating is a major cause of vehicle breakdowns on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack. Accordingly, there is a need for efficient engine cooling system flushing methods and apparatus; however, flushing of such systems in the past required draining of the removed liquid to sewer or waste lines, which was environmentally objectionable. Accordingly, need has developed for apparatus and method to clean engine coolant systems without such drainage. No way was known for accomplishing this objective in the usually advantageous manner as in now provided by this invention.

SUMMARY OF THE INVENTION

It is a major object of the invention to provide procedures and apparatus characterized as overcoming the above objections and as meeting the above needs, whereby rapid cleaning of the engine coolant system may be accomplished in an environmentally non-objectionable manner.

Basically, the method of the invention embodies the steps:

(a) forcing the liquid coolant from the cooling system to the exterior of that system, (b) treating the coolant liquid in a zone or zones outside the cooling system, said treating including removing contaminant from the coolant liquid, and (c) returning the treated coolant liquid to the cooling system.

It is another objective of the invention to supply a pressurized gas such as air to the cooling system in such a way as to drive coolant therefrom, for external treatment as in a holding tank zone.

Another objective is to provide a siphoning probe insertible into the radiator associated with the engine to provide a path for coolant to exit the radiator from its lower interior, for external treatment.

Additional steps include filtering contaminant particulate from the coolant as it flows to the external treatment zone; adding fresh chemicals to the coolant in the treating zone; employing gas pressure to drive the coolant from the holding zone back to the coolant system at the engine, and filtering the returning coolant.

A further objective is to employ the driving gas pressure to test the coolant system for any leakage; and yet another objective it to add metal plating ions to the coolant being returned to the engine coolant system, for plating onto cleaned metal surfaces to assist in preventing corrosion.

These and other objects and advantages of the invention, as well as the details of an illustrative embodiment, will be more fully understood from the following specification and drawings, in which:

DRAWING DESCRIPTION

FIG. 1 is a schematic view of apparatus employing the invention.

DETAILED DESCRIPTION

Figure 1:
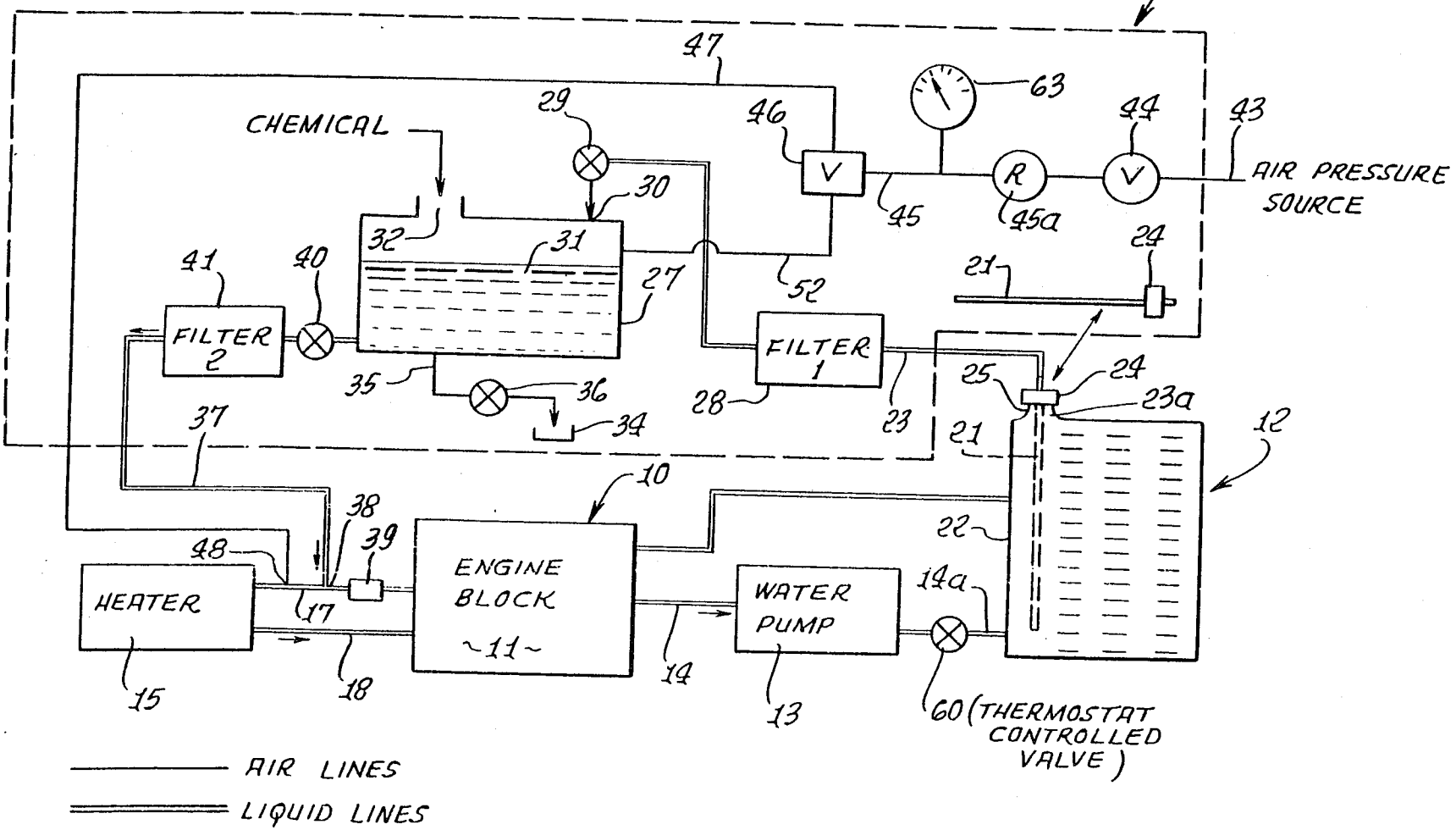

In FIG. 1, there is schematically shown an internal combustion engine 10 having a block 11 defining coolant passages through which liquid coolant (such as water, and anti-freeze additive including polyethylene glycol, etc.) is adapted to pass; a radiator 12; and a coolant pump 13 connected to pump coolant between the block and radiator, as via lines or ducts 14 and 14*a*. Also shown is a heater 15 connected at 17 with the block, as for use in a vehicle to be heated. From the heater, coolant may pass at 18 to the engine block 11. During continued operation of the engine, the coolant tends to become contaminated with particulate such as rust particles and precipitate (calcium salts, etc.), and the additive degenerates. In the past, the coolant was drained from the system as to sewer lines, and the system flushed with liquid which was also drained. The present invention eliminates such environmentally objectionable draining.

In accordance with the invention, apparatus generally designated at 20 is provided, and comprises:

(a) first means for forcing the coolant liquid from the cooling system to the exterior of that system, (b) second means in communication with said first means for receiving the coolant liquid at the exterior of the cooling system, for treatment thereof, and (c) third means in communication with said second means for returning the treated coolant liquid to the cooling system.

While specific means are shown within the overall block 20, it will be understood that other, or equivalent means are usable to perform the following steps:

(a) forcing the liquid coolant from the cooling system to the exterior of that system, (b) treating the coolant liquid in a zone or zones outside the cooling system, said treating including removing contaminant from the coolant liquid, and (c) returning the treated coolant liquid to the cooling system.

In this regard, it will be noted that the method and apparatus makes possible the re-use of the coolant by withdrawing it from the coolant system, treating it externally of that system, and re-circulating the rejuvenated coolant back into the system so as to avoid need for disposal of the coolant as by drainage to the environment.

The specific means illustrated incorporates multiple and unusual advantages in terms of simplicity, effectiveness and rapidity of employment and operation; for example, the first means for forcing the liquid coolant from the coolant system may advantageously include an elongated tube or tubular probe 21 insertible endwise into the outer container or shell 22 incorporated by the radiator, and via the usual fill opening 23*a* of that shell to extract coolant from the lower interior or extent of the radiator, for passage from the radiator as via duct 23. Means 24 associated with, and typically carried by that tubular probe 21, is provided for maintaining the fill opening otherwise closed during removal of coolant from the radiator. Such means may comprise a screw-on cap 24 which is annular to pass the elongated tube 21. Cap is screwed onto the neck 25 of the radiator fill-opening, the probe then reaching or extending to the bottom interior of the radiator so that substantially all liquid may be removed, extracted or siphoned from the radiator, to the line 23. As will appear, liquid in the heater and block flows to the radiator for such removal, and typically under pressure within the radiator so as to flow up the tubular probe to the external line 23 and then to a treatment zone.

The second means for treating the removed coolant may advantageously comprise a liquid receiver, such as for example a holding tank 27 to which liquid flows via line 23, filter 28 connected in series with that line, and valve 29 in the line. Particulate and congealed substances in the flowing liquid are removed by the filter 28, which may be replaced at intervals; the used-up filter then being disposed of in accordance with environmentally acceptably safe procedures. The normally aqueous liquid received into the holding tank interior zone 31, as via inlet 30 may then be treated, as by addition of chemical agent or agents introduced via port 32. Such chemicals may include corrosion inhibitor i.e. anti-rust compound, pH adjustment chemicals, and fresh anti-freeze compound (glycol, for example). If any sludge develops in tank 27 after prolonged use, it may be removed to a container 34 and disposed of, environmentally safely. See line 35 and valve 36.

The third means for returning the treated coolant to the engine cooling system includes a line or duct 37 extending from tank 27 to a connection 38 with the cooling system. Connection 38 is advantageously located in the line 17 from the block 11 to the radiator. A clamp 39 may be located on or at that line for storing liquid passing from 38 to the block, via line 17. A control valve 40 and a filter 41 are connected in series with line 37, valve 40 being opened when return of coolant the system is desired. Filter 41 removes any further contaminant, and it may contain meal powder to dispense metallic ions into the return coolant, for preventing electrolysis that would otherwise result in plating effect as regards exposed metal surfaces in the heater, or block, or pump, or radiator, to help protect against corrosion. Examples of such metal powder for neutralizing electric charge (cathodic protection) are:

(1) zinc
(2) magnesium
(3) aluminum

An important feature of the invention is the provision, in association with the first means referred to above, of a pressurized gas (as for example air pressure) source 43 connectible via a main valve 44 in duct 45 and a control valve 46, connected via duct 47 with the coolant system, for forcing coolant from that system and to tank 27 (as via the probe 21 and line 23). Line 47 may be connected to duct 17, at 48, as shown. Air pressure then drives coolant from the heater to the radiator, as via line 18, and the pump 13, coolant also flowing from the block to the radiator lower interior extent, for pick-up by the probe 21.

Valve 46 is advantageously a three-way valve, and is thus controllable to alternatively supply air under pressure via line 52 to the holding tank interior for application to treated liquid 31 in the tank for return supply under pressure to the engine cooling system, along the flow path described above. During such re-supply, the fill opening 23*a* of the radiator is kept open to exhaust spent gas or air. Accordingly, the probe is removed from the radiator during such return of treated coolant to the system.

Prior to initial operation of the system, the engine is operated to heat the coolant in the system, and as a result a thermostat controlled valve in that system, indicated at 60, is opened when the coolant reaches a predetermined temperature. Rust loosening or cleaning chemical additive (such a detergent solution) may be initially added to the coolant in the radiator to circulate during warm-up. The probe 21 is then inserted in the radiator, and operation of the apparatus is begun. Note that the apparatus is quickly connectible to the cooling system, as via hoses or lines 23, 37 and 47.

Finally, a pressure gauge 63 is connected to air line 45 to indicate the pressure in that line. After air pressure has returned the treated coolant to the system, the radiator fill opening 23*a* is closed as by returning the radiator cap to neck 25, and tightening it to seal the opening 23*a*. Thereafter air pressure from supply 43 pressurizes the entire coolant system, and gauge 63 is observed to note the pressure. Air pressure regulator 45*a* in line 45 regulates the pressure to a cap level. Valve 44 is then closed, and the gauge 63 is again observed to note any relatively rapid fall-off of pressure. If that does not occur, the pressure test indicates a non-leaking system; however, if the pressure falls-off, the test indicates that a leak has developed in the coolant system, and should be attended to. For example, a STOP-LEAK solution may be added to the contents of the radiator in an effort to arrest the pressure leak.

SUMMARY OF OPERATION

The following is a summary of steps that may be carried out during performance of the method of the invention:

(1) Add cleaning or flushing chemicals to engine coolant system after preliminarily testing the system for leaks;

(2) connect apparatus 20 to the cooling system as shown in FIG. 1, and as described above;

(3) Operate engine for about ten minutes to circulate the chemicals for loosening dirt, rust, sludge, ect., and also to warm up coolant solution so that thermostat controlled valve 60 opens, at about 190°–205° F.

(4) Insert probe 26 into radiator and tighten its cap means 24 to the neck 25.

(5) Open valve 44 and adjust valve 46 to direct air pressure to connection 48, which causes air pressure to drive coolant from the system to holding tank 27, via probe 21, filter 28, and valve 29, which is OPEN.

(6) Close valve 44 and add treating chemical coolant in the tank, via inlet 32.

(7) Remove probe 21 from the radiator, and leave fill-opening 23*a* open.

(8) Open valve 44 and adjust valve 46 to direct air pressure to tank 27, via line 52. Inlet 32 should be closed. This drives coolant from the tank, through filter 41, and to the coolant system at line 17. Excess air vents at fill-opening 23*a*.

(9) When all coolant has been returned to the system (as can be viewed via line 37 which is transparent), the radiator cap is returned to neck 23*a* and tightened.

(10) Pressurized the coolant system, and close valve 44.

(11) Observe gauge 63 for any pressure leaks.

(12) Relieve pressure in the system as by slowly opening the cap at the radiator neck 25.

(13) Disconnect the hoses or lines from the line 17.

The connections to line 17 may take the form of those described in U.S. Pat. No. 4,109,703, FIG. 12; and the connector means 24 may take the form of that described in U.S. Pat. No. 4,109,703, FIG. 10.

I claim:

1. In the method of treating coolant liquid in an internal combustion engine cooling system, wherein the cooling system includes a heat radiator including a container having a fill opening, the steps that include:

(a) forcing the coolant liquid from the cooling system to the exterior of that system, wherein said forcing step includes supplying a pressurized gas to the cooling system to drive coolant liquid therefrom, (b) treating the coolant liquid in a zone or zones outside the cooling system, said treating including removing contaminant from the cooling liquid, and (c) returning the treated coolant liquid to the cooling system, (d) said forcing step including employing said gas to drive coolant liquid from the radiator via said container fill opening.

2. The method of claim 1 including providing an elongated tube and inserting the tube into the radiator via said fill opening to extract said coolant liquid from the lower extent of the radiator for said passage from the radiator, and maintaining said fill opening otherwise closed during said passage of coolant liquid from the radiator.

3. The method of claim 1 wherein said treating step includes filtering contaminant particles from the cooling liquid.

4. The method of claim 1 wherein said treating step includes collecting said coolant liquid in a holding zone, and adding chemical agent or agents to the collected liquid in the holding zone.

5. The method of claim 4 wherein said returning step includes filtering the liquid while returning the liquid from the holding zone to the cooling system.

6. The method of claim 5 wherein the cooling system includes cooling passages in an engine block and in a heater, there being a coolant flow connection passage between said coolant passages in the block and heater, and wherein said returning step includes returning the treated liquid to said flow connection passage.

7. The method of claim 1 wherein said returning step includes supplying pressurized gas to drive treated coolant into the cooling system.

8. The method of claim 5 wherein said returning step includes supplying pressurized gas to the holding zone to drive treated liquid therefrom and to the cooling system.

9. The method of claim 7 wherein the cooling system includes a heat radiator including a container having a coolant liquid fill opening, and including the step of maintaining that fill opening open during the gas pressure driving of treated liquid to the cooling system so as to pass spent gas from the cooling system.

10. The method of claim 1 including providing an elongated tube and inserting the tube into the radiator via said fill opening to extract said coolant liquid from the lower extent of the radiator for said passage from the radiator, and maintaining said fill opening otherwise closed during said passage of coolant liquid from the radiator.

11. The method of claim 1 wherein said gas comprises compressed air.

12. The method of claim 9 wherein said gas comprises compressed air.

13. The method of claim 1 wherein the cooling system includes a thermostat controlled valve that only opens when the coolant liquid has reached a predetermined temperature during initial operation of the engine, and including the initial step of operating the engine to heat the coolant to effect opening of said valve, prior to said forcing step.

14. The method of claim 7 including the step of employing said pressurized gas to pressurize the coolant in the system after said return of treated coolant into the system, and monitoring the pressure of the coolant in the system to detect any reduction thereof that would indicate the existence of a leak.

15. The method of claim 14 wherein the cooling system includes a heat radiator including a container having a coolant liquid fill opening, and including the step of maintaining that fill opening open during the gas pressure driving of treated liquid to the cooling system so as to pass spent gas from the cooling system.

16. The method of claim 1 including dispensing metallic plating ions into the cooling liquid being returned to the cooling system.

17. In the method of treating coolant liquid in an internal combustion engine cooling system, the steps that include:

(a) forcing the coolant liquid from the cooling system to the exterior of that system wherein said forcing step includes supplying a pressurized gas to the cooling system to drive coolant liquid therefrom, (b) treating the coolant liquid in a zone or zones outside the cooling system, said treating including removing contaminant from the coolant liquid, and (c) returning the treated coolant liquid to the cooling system, (d) the cooling system including a heat radiator including a container having a coolant liquid fill opening, and including the step of extracting coolant liquid from lower extent of the radiator container for passage from the radiator to said zone or zones during said forcing step, wherein said extracting step is carried out to pass extracted coolant through said fill opening.

18. The method of claim 17 wherein said extracting step is carried out to displace coolant substantially vertically from said lower extent of the radiator container.

* * * * *